US005176554A

United States Patent [19]

Simmons

[11] Patent Number: 5,176,554

[45] Date of Patent: Jan. 5, 1993

[54] AQUATIC FLOTATION DEVICE

[76] Inventor: Thomas R. Simmons, 3510 Lobit, Dickinson, Tex. 77539

[21] Appl. No.: 904,644

[22] Filed: Jun. 26, 1992

[51] Int. Cl.[5] ..... B63C 9/08

[52] U.S. Cl. ..... 441/129

[58] Field of Search ..... 441/35, 37, 80, 125, 441/128-132, 135, 136

[56] References Cited

U.S. PATENT DOCUMENTS 1,829,137 10/1931 Harris ..... 441/129

5,088,723 2/1992 Simmons ..... 441/130

*Primary Examiner*—Jesus D. Sotelo

*Attorney, Agent, or Firm*—Marvin J. Marnock

[57] ABSTRACT

A buoyant aquatic recliner device (10) comprised of a plurality of body supporting sections (11,12,13) flexibly interconnected and adapted to support a person reclined thereon. One body supporting section (11) supports the torso of the reclined person, a second section (12) supports the thighs and a third section (13) supports the lower legs. Each body supporting section comprises a pair of linear side members (21-26) of substantially equal length interconnected by pliant spacer members (30) which maintain the paired side members substantially parallel and in symmetrical relation about the longitudinal axis of the device. At least one flotation member (60) is affixed to each side member of the body supporting sections and is adjustably positioning thereon along the length of the side member to adjust the relative angles of inclination of adjoining body supporting sections to achieve a preferred body position. The number of flotation devices (60) for each body supporting section (11,12,13) may be selectively increased or decreased to control the level of submergence of each section.

6 Claims, 1 Drawing Sheet

FIG. 1
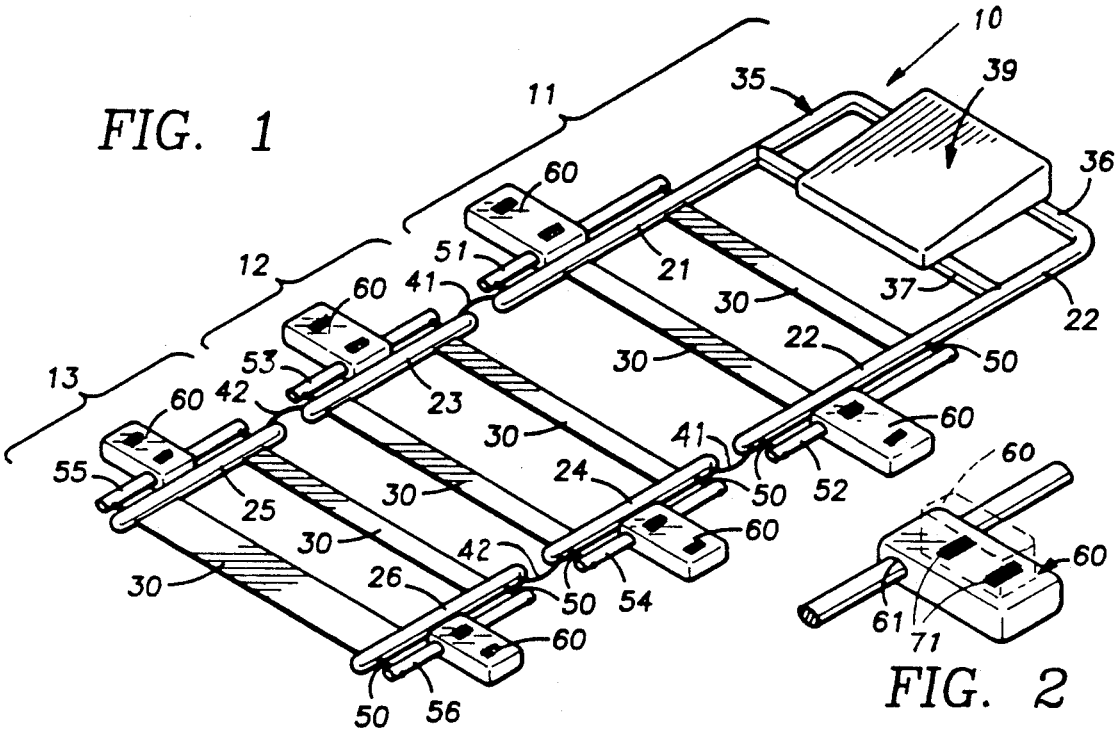
FIG. 2
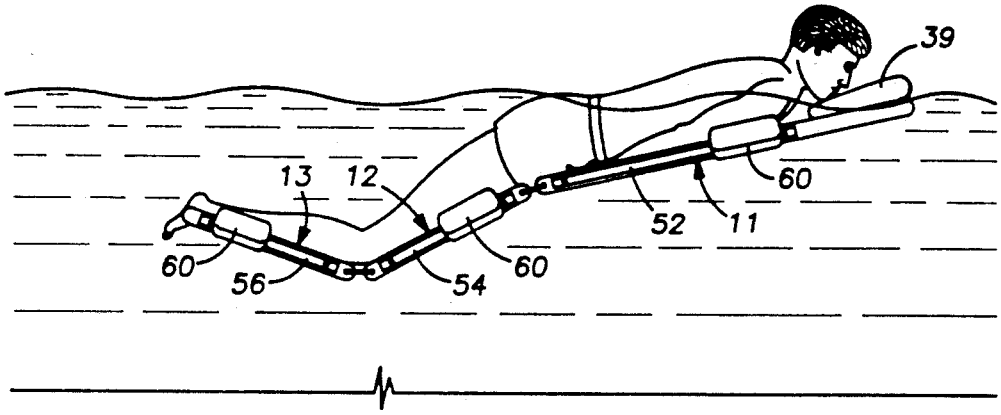
FIG. 3
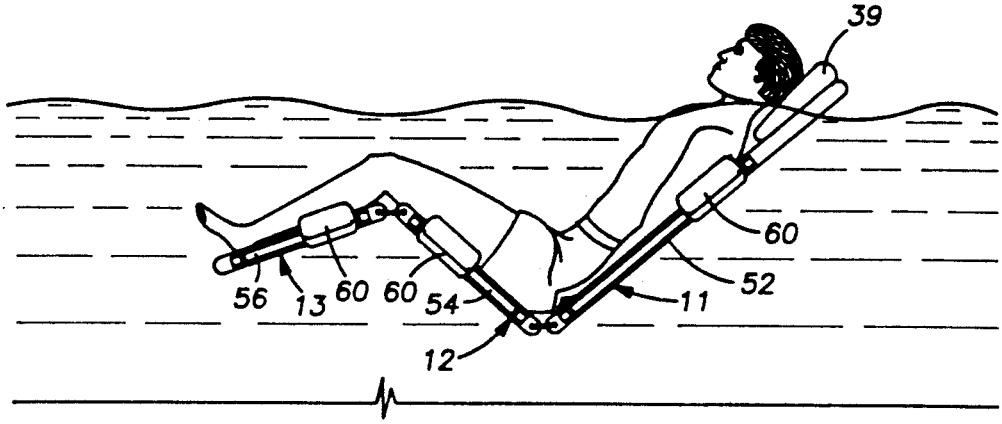
FIG. 4

AQUATIC FLOTATION DEVICE

FIELD OF THE INVENTION

This invention relates to aquatic flotation devices which are adapted to support a person reclined thereon, and more particularly to a buoyant aquatic recliner device comprised of a plurality of flexibly connected and adjoining body supporting sections, each having flotation members positionable and attachable thereon for varying the relative angles of inclination of the adjoining body supporting sections and their respective levels of submergence to achieve a preferred body position.

BACKGROUND OF THE INVENTION

Aquatic flotation devices of the type which are adapted to support a person in reclined position are of wide variety. Many of these include buoyant pads for providing buoyancy which have the disadvantage that the person supported on the buoyant pads is out of direct contact with the water and is therefore precluded from its soothing and salutary effects. Inflatable flotation devices, on the other hand, are generally more difficult to manufacture and their structural integrity is usually less reliable. Adjusting the buoyancy of a floating inflatable aquatic device, such as shown in U.S. Pat. No. 5,088,723, is also associated with a greater degree of risk and peril, particularly if attempted by a person when reclining thereon.

SUMMARY OF THE INVENTION

The invention is a buoyant aquatic device of a configuration adapted to support a person in reclined position and which is provided with means for allowing the person reclining thereon to adjust the configuration of the device and the buoyancy and inclination of its different body supporting sections. The device comprises a torso supporting section, a second section for supporting the thighs, and another section for providing support to the lower legs of the person reclined thereon. Each body supporting section comprises a pair of linear side members of substantially equal length interconnected by pliant spacer members which maintain the paired members substantially parallel and symmetrical about the longitudinal axis of the device. At least one flotation member is affixed to each side member of the body supporting sections and is adjustably positionable thereon along the length of the side member to adjust the relative angles of inclination of adjoining body supporting sections to achieve a preferred body position. By releasable attachment means the number of flotation devices for each body supporting section may be selectively increased or decreased to control the level of submergence of each section.

DESCRIPTION OF THE DRAWINGS

FIG. 1 is a perspective view of a preferred embodiment of an adjustable aquatic flotation device in accordance with the invention;

FIG. 2 is a fragmentary view in perspective of one of the flotation members of the device of FIG. 1;

FIG. 3 is a side view of the device of FIG. 1 when placed in a body of water with a person reclined thereon in face-down position with adjoining supporting sections of the device at different levels of submergence and at different angles of inclination; and FIG. 4 is a view similar to FIG. 3 but showing the adjustable aquatic flotation device of the invention located in a spa and a person supported thereby in a sitting position.

DETAILED DESCRIPTION OF THE INVENTION

Referring more particularly to the drawings, there is shown in FIG. 1, an aquatic flotation device 10 in a preferred embodiment of the invention. The device 10 comprises a plurality of adjoining body supporting sections of which a first body supporting section 11 is adapted to support the torso of the person reclined therein, a second body supporting section 12 is adapted to support the person's thighs, and a third body supporting section 13 is adapted to support the person's lower legs. Each body supporting section comprises a pair of elongated substantially rigid and inelastic side members, such as paired members 21,22 for body supporting section 11, and similar pairs 23,24 and 25,26 for body supporting sections 12 and 13 respectively. The side members 21–26 are of a light weight material such as plastic or the like, and are joined in a substantially parallel relationship by spacer members 30 of a pliant plastic material. The spacer members 30, which are bonded to the side members in any suitable manner as by heat fusion or an appropriate bonding agent, are adapted to flexibly yield to the body weight of a person supported thereon but to still maintain the side members in substantially parallel relationship and symmetrical with respect to the longitudinal axis of the device.

It is also to be noted that the spacer members 30 connecting side members 21,22 of the torso supporting section 11 are further separated in the longitudinal direction of the device 10 than are the spacer members 30 for the leg supporting section 13 and differently spaced from the spacer members in the thigh supporting section 12. Furthermore, while shown to all be of the same length, the spacer members 30 of one body supporting section, such as the lower leg section 13, could also be shorter than those of the sections 11 and 12 to thereby provide a narrower body supporting section.

In most instances, the spacer members 30 would be separated so that an occupant of the recliner device 10 could receive the greatest benefit of a bubble massage when the device is placed in a spa. It is also to be noted, the side members 21,22 are the legs of a U-shaped member 35 and are joined by a cross span beam 36 and an adjacent parallel cross span beam 37 which are desirably more rigid than the spacer members 30. The cross spans 36,37 provide support for a headrest 39 which is mounted centrally thereon in suitable fashion as by a bonding agent. The headrest 39 can be of any suitable material, preferably buoyant.

As best seen in FIG. 1, the side members 21,22 of section 11 are flexibly connected to the side members 23,24 of section 12 at their respective adjacent paired ends by means of flexible straps 41. In like manner, the side members 23,24 are flexibly connected to the side members 25,26 at their respective adjacent paired ends by flexible straps 42.

While the lengths of the straps 41,42 is not critical, it is nevertheless desirable that they be of a length of approximately six inches such that the device 10 can readily accommodate persons of different sizes and different lengths of torso. The straps which might be of ordinary rope or vinyl material, might also be formed as closed loops. Also, as best seen in FIG. 1, there is attached to each of the side members 21-26, a slide rod located outboard of the side member to which it is attached and in substantially parallel relation thereto. For body supporting section 11, slide rods 51,52 are attached respectively to the side members 21,22 preferably by bolted clamps 50 or by any other suitable means. Corresponding slide rods 53,54 are similarly attached to the side members 23,24 of body supporting section 12 and slide rods 55,56 are attached to the side members of body supporting section 13. For purposes to be hereinafter explained, the slide rods 51-56 are of elliptical cross sections.

On each of the slide rods 51-56, a flotation member 60 is slidably attached. Each flotation member 60, as best shown in FIG. 2, is of a generally parallelepiped configuration and is provided with an elliptically shaped bore or passage 61 which extends transversely therethrough. A suitable material for a flotation member 60 is a closed cell sponge rubber including synthetic materials such as chloroprene or neoprene and commercial products such as "Ensolite". In assembly of the device 10, a flotation device 60 is mounted to a slide rod, one of the slide rods 51-56, by insertion of the rod through the bore 61. The rod is then mounted to one of the side members of a body supporting section of the device 10. The bore 61 is of a size such that there is a constant friction fit or an adjustable friction fit between the flotation member and the slide rod to which it is attached. For this purpose, it may be necessary to use bearing surfaces which may be of like or unlike materials. Preferably, the friction is such that the flotation member can be moved along the slide rod by a relatively small force so that it may be adjustably positioned along the length of the slide rod. By placing both flotation members 60 as are associated with a particular body supporting section, in similar positions along the length of the slide rods to which they are attached, it is possible to vary the angle of inclination of each body supporting section as desired.

The elliptical cross sections of the side rods 51-56 and the pliancy of the flotation members 60 combine to enhance the friction therebetween as the flotation members 60 tend to clamp against the slide rod as the device 10 submerges. They are thereby easily retained in their selected positions on the slide rods. For purposes of stability, it is preferred that the flotation members attached to one side of a body supporting section (11,12 or 13) are of equal size or of equal buoyancy with respect to the flotation members attached to the other side.

As shown in FIG. 3, a person may assume a partially submerged position on the device 10 and may adjust his position in the water by adjusting, preferably in unison, the location of each flotation member along the sides of each body supporting section and by so doing adjust the relative angles of inclination of the adjoining body supporting sections. In addition, the general buoyancy of each body supporting section may also be adjusted to accommodate different body weights or to vary the depth of submergence by adding or subtracting flotation members to the sides of the body supporting section. For this purpose, each flotation member 60 is provided with VELCRO type hook fastener patches 71 which are glued or bonded to its top surface, or its end, bottom or side surfaces, and adapted to fastenably engage with VELCRO loop fastener patches which are similarly affixed to one of the surfaces of a second flotation member, as shown in dashed lines in FIG. 2. By stacking an additional flotation member 60 atop a flotation member mounted on the side rod, the buoyancy of a section may be increased. Obviously, the size, the shape and the number of such flotation members can be varied as desired and the addition or removal of flotation members can be made by the person when reclined on the aquatic device.

The level of submergence of a body supporting section of the device 10 is a function of the buoyancy of the sections and the body weight which it supports whereas the angle of inclination of the body supporting section is controlled by the selected position of its flotation members. For adjoining body supporting sections, their inclinations can be adjusted to achieve a desired body position such as the body position shown in FIGS. 3 and 4. Furthermore, by virtue of the wide spacing between the spacer members 30, there is large area contact of the person's body with the water which is particularly beneficial when the device is placed in a spa as shown in FIG. 4 and the pressured jets of air and water can therefore make direct contact with the body. It is also possible for an occupant in reclined position to maneuver the device 10 without great difficulty by using his arms as oars.

It is therefore to be seen that an aquatic device is disclosed herein which is adapted to support a person reclined thereon and which is provided with adjustable flotation members whereby the person can readily adjust the levels of buoyancy and relative angles of inclination of different sections thereof to assume a partially submerged preferred position.

It is also to be understood that the foregoing description of the invention has been presented for purposes of illustration and explanation and is not intended to limit the invention to the precise forms disclosed. It is to be appreciated therefore that various material and structural changes may be made by those skilled in the art without departing from the spirit of the invention.

I claim:

1. An aquatic device of a length and configuration adapted to support a person in reclined position thereon, said device comprising:

a torso support section for supporting the torso of a person, a thigh support section adjoining the torso support section for supporting the thighs of said person, and a leg support section adjoining the thigh support section for supporting the lower legs of said person, each said support section comprising a pair of linear side members of substantially equal length and a plurality of pliant spacer members which interconnect the pair of side members and maintain the paired side members substantially parallel and in symmetrical relation about the longitudinal axis of said device;

means for flexibly interconnecting said adjoining support sections;

at least one flotation member affixed to each side member of said support sections, said flotation members being adjustably positionable along the length of the side members to which they are attached to control the inclination and the relative angles of inclination of adjoining support sections to achieve a preferred body position; and means for attaching additional flotation members to each body support section to selectively increase the buoyancy of each said support section.

2. An aquatic device as set forth in claim 1 further including a buoyant headrest member affixed to said torso support section at one end of said device whereby a person reclined on the aquatic device can submerge said torso, thigh and leg support sections and his own body thereon while retaining his head above water.

3. A buoyant aquatic flotation device comprising:

a plurality of body supporting sections flexibly interconnected and adapted to support a person reclined thereon with one of said body supporting sections adapted to support the torso of the reclined person, a second of said sections adapted to support the thighs of said person and a third of said sections adapted to support the lower legs of said person, each said supporting section comprising a pair of linear side members of substantially equal length, a plurality of pliant spacer members interconnecting the side member of each said pair and maintaining the paired side members substantially parallel and in symmetrical relation about the longitudinal axis of said device;

at least one flotation member affixed to each side member of all said body supporting sections, means for adjustably positioning the flotation member along the length of the side member to adjust the relative angles of inclination of said adjoining body supporting sections to achieve a preferred body position; and means for attaching additional flotation members to the body supporting sections for selectively increasing the buoyancy thereof.

4. A buoyant aquatic flotation device comprising:

a plurality of body supporting sections flexibly interconnected and adapted to support a person reclined thereon with a first one of said body supporting sections adapted to support the torso of the reclined person, a second of said sections adapted to support the thighs of said person and a third of said sections adapted to support the lower legs of said person, each said supporting section comprising a pair of linear side members of substantially equal length and a plurality of pliant spacer members interconnecting each side member of each said pair and maintaining the paired side members substantially parallel and in symmetrical relation about the longitudinal axis of said device, each said side member being provided with a slide rod of substantially equal length which is attached thereto in a substantially parallel and relative outboard position; and a plurality of flotation members, each of said slide rods having at least one of said flotation members slidably mounted thereon and adjustably positionable along the length thereof.

5. A buoyant aquatic flotation device as set forth in claim 4 wherein the paired side members of the body supporting section for the lower legs of the reclined person are closer spaced to the longitudinal axis of said device than are the paired side members of said first body supporting section which is adapted to support the torso of said person.

6. A buoyant aquatic flotation device as set forth in claim 5 wherein the paired side members of said second body supporting section are closer spaced than are the paired side members of said first body supporting section.

* * * * *